United States Patent [19]

Thompson

[11] Patent Number: 4,984,975

[45] Date of Patent: Jan. 15, 1991

[54] ROTARY PUMP WITH CUTTING MEANS

[76] Inventor: George A. Thompson, 114 Demotte Ave., Daytona Beach, Fla. 32019

[21] Appl. No.: 301,786

[22] Filed: Jan. 26, 1989

[51] Int. Cl.[5] ..... F04C 13/00

[52] U.S. Cl. ..... 418/181

[58] Field of Search ..... 418/181, 205, 206

[56] References Cited

U.S. PATENT DOCUMENTS

| | | | |
|---|---|---|---|
| 1,053,677 | 3/1912 | Sutton | 418/206 |
| 1,769,153 | 3/1928 | Meyer | 418/206 |
| 2,460,278 | 2/1944 | Cook | 418/181 |

*Primary Examiner*—Leonard E. Smith
*Assistant Examiner*—John A. Savio, III
*Attorney, Agent, or Firm*—Sughrue, Mion, Zinn, Macpeak & Seas

[57] ABSTRACT

A rotary pump of the type having a pair of double-lobed intermeshing rotors rotatably mounted in a housing is provided with a concave recess in the leading edge of each lobe of each rotor which defines a cutting edge with the end surface of each lobe for comminuting solid or stringy material entrained in the liquid being pumped.

3 Claims, 2 Drawing Sheets

ROTARY PUMP WITH CUTTING MEANS

BACKGROUND OF THE INVENTION

The present invention is directed to a rotary pump of the type having two double-lobed rotors rotatable in intermeshing relation on parallel shafts in a pumping chamber, and more specifically to a rotary pump having cutting means on the lobes for comminuting sewage or garbage which might be entrained with the liquid being pumped.

Pumps or compressors of the type having two intermeshing double-lobed rotors are old and well known in the art as evidenced by the U.S. Patent to Messori 4,451,132. However, if the fluid being pumped contains sewage or garbage in the form of solid or stringy material, there is the possibility of the pump becoming clogged or jammed with the solid or fibrous material.

The U.S. Patent to Backstrom 4,637,785 is directed to a rotary pump with a cutter device for contaminated fluids. However, in this case the rotating cutter is separate from the pumping elements and is located adjacent the inlet for the masceration of solid objects to a size suitable for the subsequent passage through the pump.

The U.S. Patents to Poss 4,561,834 and Waters 2,974,700 are both directed to rotary vane pumps having knife edged vanes which cooperate with the edge of the inlet opening to shear-cut any solid material entering through the opening into the pump chamber. The vanes of such pumps slide radially in a rotor with the tips of the vanes engaging the rotor chamber's cylindrical interior surface, thereby causing substantial wear to the vanes with the attendant shortening of the life of the vanes. The vanes are relatively thin plates and are extended beyond the circumference of the rotor to the greatest extent when the vane is passing the inlet opening. The impact associated with shear-cutting can cause damage to the vanes, which also shortens the life of the vanes.

SUMMARY OF THE INVENTION

The present invention provides a new and improved rotary pump for pumping a liquid having solid or stringy material entrained therein which overcomes the drawbacks associated with the prior art constructions discussed above.

The present invention provides a new and improved rotary pump comprising a casing having an inlet and outlet in communication with an internal pumping chamber, a pair of double-lobed rotors rotatably mounted in intermeshing relation on a pair of parallel shafts and cutting means integrally formed in each lobe of each rotor for comminuting solid or stringy material as the material enters the pumping chamber to said inlet.

The foregoing and other objects features and advantages of the invention will be apparent from the following more particular description of a preferred embodiment of the invention, as illustrated in the accompanying drawings.

DETAILED DESCRIPTION OF THE INVENTION

Figure 3:
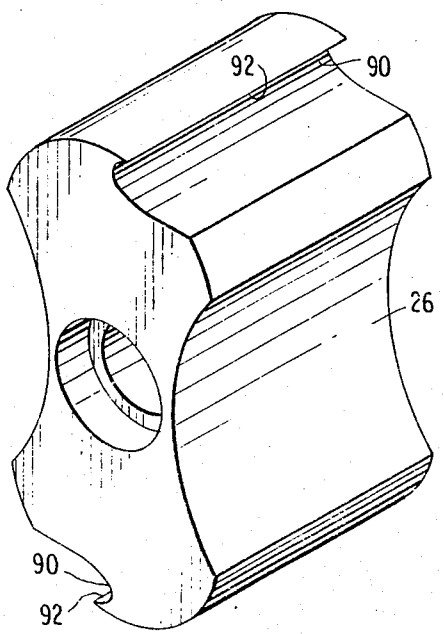
FIG. 3 is a perspective view of one of the rotors for the pump shown in FIGS. 1 and 2.

The pump 10 according to the present invention is provided with a housing having a substantially oval configuration which is mounted on a base 14. The first cavity 16 is provided in one end of the housing 12 which constitutes the pumping chamber. First and second shafts 18 and 20 are rotatably mounted in the housing 12 by suitable bearings 22 and 24, respectively. The shafts 18 and 20 are disposed parallel to each other and extend into the pumping chamber 16. A pair of identical double-lobed rotors 26 and 28 are secured on the shafts 18 and 20, respectively, for rotation therewith by keys 30 and 32. The shafts 18 and 20 are provided with stepped flanges 31 and 33 and annular sealing rings 34 and 36 are mounted on the shafts 18 and 20 between the rotors 26 and 28 and the stepped flanges 31 and 33, respectively. Clamping plates 35 and 37 are secured to the ends of the shafts 18 and 20 by means of bolts 38 and 40 to securely position the rotors 26 and 28 between the clamping plates 35 and 37 and the sealing rings 34 and 36, respectively. Spring means 39 and 41 are located between flanges 42 and 43 on the shafts 18 and 20 and the sealing rings 34 and 36, respectively, whereby the sealing rings are pressed into firm sealing engagement with the rotors 26 and 28.

Figure 1:
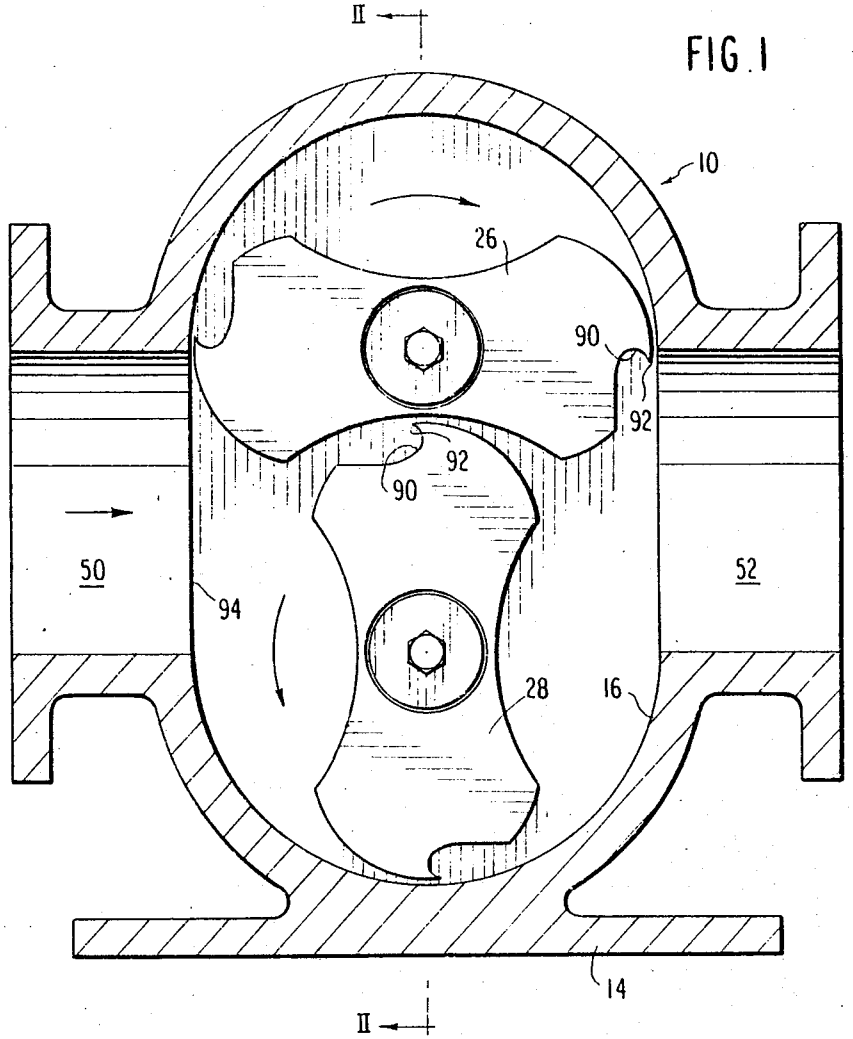
FIG. 1 is a sectional view of the pump according to the present invention, taken along the line I—I.
Figure 2:
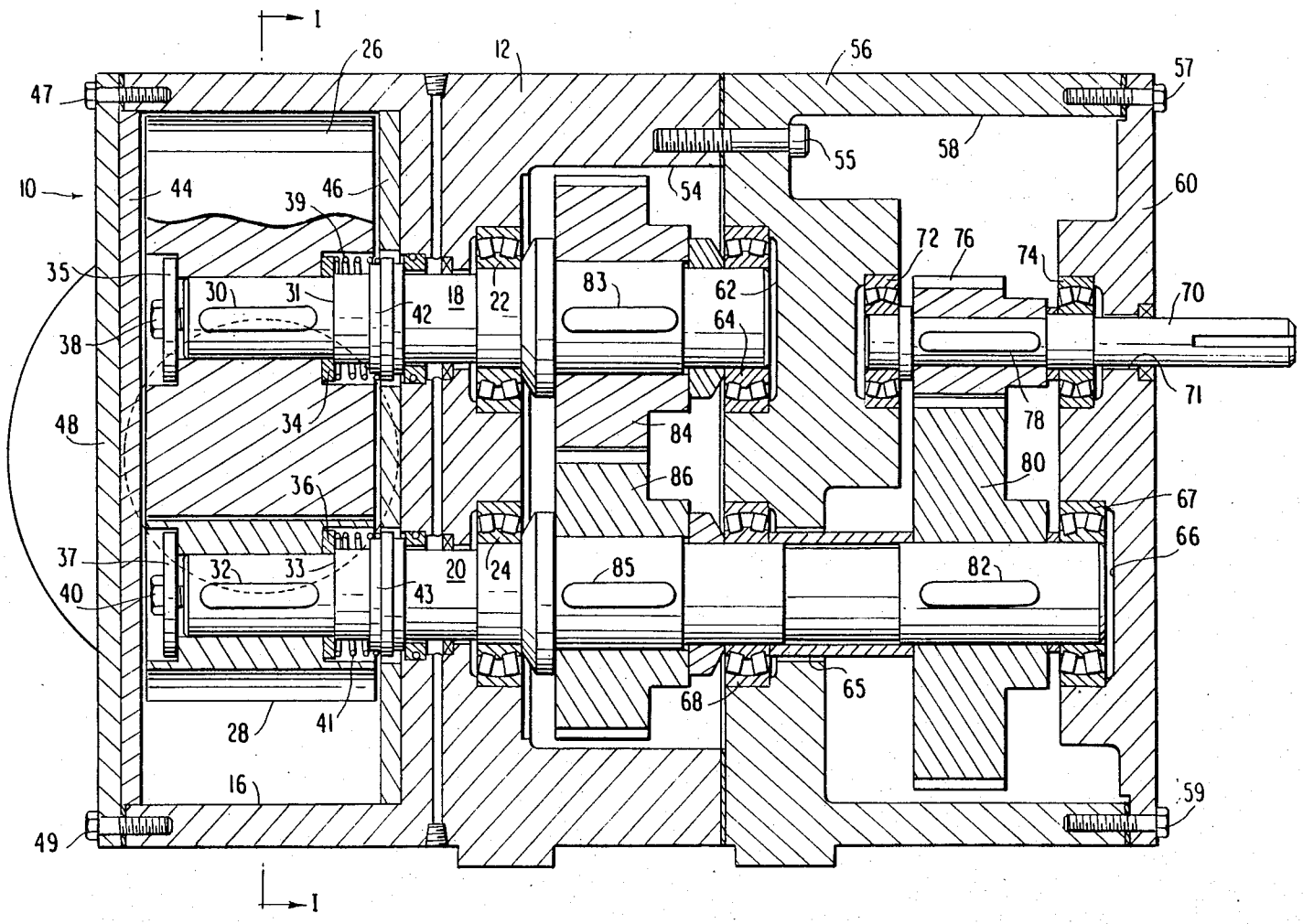
FIG. 2 is a sectional view of the pump taken along the line II—II in FIG. 1.

The double lobed rotors 26 and 28 are secured to the shafts substantially perpendicular to each other in intermeshing engagement as is well known in pumps of this type. The two rotors are provided with close tolerances relative to each other and the housing but do not touch each other or the housing upon rotation within the pumping chamber 16. While FIG. 2 is a sectional view taken along the line II—II of FIG. 1, the rotors have been rotated 90° from their position shown in FIG. 1. A pair of wear plates 44 and 46 are disposed in the pumping chamber 16 on opposite sides of the rotors 26 and 28 and an end plate 48 is secured to the end of the housing 12 by means of bolts 47 and 49 to close the pumping chamber. The pumping chamber is provided with an inlet 50 and an outlet 52 as shown in FIG. 1, which may be connected by any suitable means to suitable conduits.

The housing 12 is provided with a second cavity 54 in the end thereof opposite the end containing the cavity 16. A reduction gear casing 56 is secured to the end of the housing 12 by means of bolts 55, only one of which is shown in FIG. 2. The reduction gear casing 56 is provided with the cavity 58 which, in turn, is closed by an end wall 60 which is secured to the casing by means of bolts 57 and 59.

The shaft 18 extends through the cavity 54 and is rotatably supported in a recess 62 in the casing 56 by means of a bearing assembly 64. The shaft 20 extends through the cavity 54 and opening 65 in the casing 56 and the cavity 58 with the opposite end thereof being rotatably supported in a cavity 66 in the end plate 60 by means of a bearing assembly 67. The shaft 20 is also supported by a bearing assembly 68 at one end of the aperture 65 in the casing 56. An input shaft 70 which is adapted to be secured to any suitable drive means such as an electric motor or the like extends through an aperture 71 in the end plate 60 and is rotatably supported in the casing 56 and the end plate 60 by means of bearing assemblies 72 and 74.

A first gear 76, having a relatively small diameter, is secured to the shaft 70 by means of a key 78 and is disposed in meshing engagement with a second gear 80 having a relatively larger diameter and which is secured to the shaft 20 by means of a key 82. Two identical gears 84 and 86 are secured to the shafts 18 and 20 in meshing engagement with each other by keys 83 and 85, respectively. Thus, the two rotors 26 and 28 are driven at the same speed which is less than the speed of the input shaft 70 for pumping a liquid from the inlet to the outlet of the housing.

The leading edge of each lobe of each rotor is provided with a concave recess 90 which defines a sharp cutting edge 92 which is parallel to the shaft on which the rotor is secured. Thus, upon rotation of the rotors relative to the annular edge 94 of the inlet passage 50, the cutting edges 92 will sever any solid or stringy matter entrained in the liquid entering the pump so that the solid or stringy matter will not clog the pump or otherwise interfere with the efficient operation of the pump. Furthermore, the turbulence within the recesses 90 on the rotors 26 and 28 entrains any grit which is carried by the liquid in a manner which prevents the grit from entering the clearances between the rotors and the housing to thereby reduce the wear on the housing as well as on the rotors. Thus, the pump according to the present invention is extremely efficient for handling sewage, trash, wellpoint systems and storm water.

While the invention has been particularly shown and described with reference to a preferred embodiment thereof, it will be understood by those in the art that various changes in form and details may be made therein without departing from the spirit and scope of the invention.

I claim:

1. A rotary pump comprising housing means having a pumping chamber in communication with an inlet passage and an outlet passage opposite said inlet passage, a pair of parallel spaced apart drive shafts extending into said casing orthogonal to a line extending through said inlet passage and outlet passage, a pair of identical double-lobed rotors secured to said shafts for rotation therewith in intermeshing engagement for pumping liquid and cutting means on each lobe of each rotor extending parallel to said shafts for comminuting solid or stringy material entrained in said liquid as said cutting means passes an edge of said housing between said inlet passage and said chamber.

2. A pump as set forth in claim 1 wherein said cutting means is comprised of a concave recess formed in the leading edge of each lobe of each rotor which defines a sharp cutting edge at the juncture between said concave recess and an end surface of each lobe.

3. A pump as set forth in claim 1 further comprising a cavity formed in said housing on a side thereof opposite to said pumping chamber into which said shafts extend, intermeshing gears mounted on said shafts in said cavity, a reduction gear casing secured to said housing adjacent said cavity, and reduction gear means adapted to be connected to a suitable drive source mounted in said casing and outwardly connected to said gears.

* * * * *